United States Patent [19]

Tyson

[11] Patent Number: 4,605,501

[45] Date of Patent: Aug. 12, 1986

[54] FLOW DIVIDER FOR DISTRIBUTION SYSTEMS

[76] Inventor: James E. Tyson, 10621 Six Forks Rd., Raleigh, N.C. 27614

[21] Appl. No.: 754,240

[22] Filed: Jul. 12, 1985

[51] Int. Cl.[4] ..... B01D 21/24

[52] U.S. Cl. ..... 210/519; 210/170; 210/532.1; 210/532.2; 138/92; 137/561 A; 137/559

[58] Field of Search ..... 210/170, 519, 532.1, 210/532.2; 138/92; 137/561 A, 559, 800, 872

[56] References Cited

U.S. PATENT DOCUMENTS

| | | | |
|---|---|---|---|
| 1,191,148 | 7/1916 | Braaten | 138/92 |
| 3,497,067 | 2/1970 | Tyson | 210/259 |
| 3,956,137 | 5/1976 | Dempsey | 210/532.2 |
| 4,261,386 | 4/1981 | Young | 137/800 |
| 4,262,701 | 4/1981 | Beacon | 138/92 |
| 4,298,470 | 11/1981 | Stallings | 210/532.2 |
| 4,536,104 | 8/1985 | Büngert | 137/561 A |

FOREIGN PATENT DOCUMENTS

| | | | |
|---|---|---|---|
| 472879 | 4/1951 | Canada | 210/532.2 |

*Primary Examiner*—Benoît Castel
*Assistant Examiner*—Linda S. Evans
*Attorney, Agent, or Firm*—Mills & Coats

[57] ABSTRACT

This invention is an improved distribution joint used in conjunction with septic tank absorption field systems. The invention more particularly divides and accurately controls the distribution of septic tank effluent into separate portions of the absorption fields while eliminating the buildup of flow disrupting sediment on the divider by providing a unique flow pattern thereover.

6 Claims, 3 Drawing Figures

FLOW DIVIDER FOR DISTRIBUTION SYSTEMS

FIELD OF INVENTION

This invention relates to sewage disposal systems and more particularly to effluent flow controller.

BACKGROUND OF INVENTION

In the past, the absorption field or subsurface tile structure of septic tank and sanitation systems has consisted of a field of 12 inch lengths of four inch architectural drain tile, 2 to 3 foot lengths of vertured clay sewer pipe, or extended lengths of perforated, non-metallic pipe. These fields are laid in such a manner that the effluent flow from the septic tank is distributed with reasonable uniformity to the ambit soil.

It is considered essential to have a distribution box or similar means in each absorption field to divert the effluent into separate pipe systems. In other words, the purpose of the box or junction is to insure equal distribution of the effluent from the septic tank into the various lateral lines. The main purpose of the junction is to prevent overloading and thus failure of one of the lines while the other line or lines are left empty.

Plain pipe fittings in the form of T's and Y's have been proposed to replace distribution boxes but they have been found not to give even distribution. Even using distribution boxes, the same must be installed in a perfectly level condition or more effluent will move into one line than the other thus causing the problems outlined above.

One earlier solution to the above-indicated problems was the present invention Distribution Means disclosed in U.S. Pat. No. 3,497,067, where a distribution box or modified T included a flow divider with a knife edge which, even though the box or joint was not level, would allow the flow of effluent to still be almost evenly divided into each of the different distribution lines.

Although the above system has proved successful in commercial use, there can still be a buildup of solid particles on or around the knife edge of the divider, particularly when the effluent is moving slowly, and can, if not eliminated, eventually cause uneven flow and defeat the purpose of the system.

SUMMARY OF THE INVENTION

After much research and study into the above-mentioned problems, the present invention has been developed to provide an improved distribution means for septic tank effluents which not only divides the effluent flow but also prevents the buildup of solids on the divider means. This is accomplished through the provision of a relatively steep knife edge beginning at an overhanging lip and extending downwardly to a second angular knife edge at the lower end thereof.

All large flows of effluent begin and end with small, slow amounts of flow. It is during this slow flow that small particles may become lodged on or adjacent the prior art flow divider and begin to build up. By having the overhanging lip adjacent the divider knife edge, even a small, slow flow, as it drops off the lip, will increase in speed thus preventing particle lodging and buildup. Also any buildup that does occur on the knife edge will eventually be washed by the heavier flows down the knife edge and from continued heavy flow pressure, will be cut by the second or angular knife edge and washed to either side thereof.

In view of the above, it is an object of the present invention to provide a distribution means for septic tank effluent which assures that undesirable buildup of solids does not occur on the flow dividing means.

Another object of the present invention is to provide an improved distribution means for septic tank and similar effluents which includes a double knife edge separating means.

Another object of the present invention is to provide a simple, relatively inexpensive, and yet highly efficient improved flow distribution means.

Another object of the present invention is to provide a simple, inexpensive, and yet highly efficient flow divider which is self-cleaning.

Another object of the present invention is to provide, in a flow dividing distribution system, an overhanging lip with adjacent knife edges for preventing buildup of solid particles.

Other objects and advantages of the present invention will become apparent and obvious from a study of the following description and the accompanying drawings which are merely illustrative of such invention.

DETAILED DESCRIPTION OF INVENTION

Figure 1:
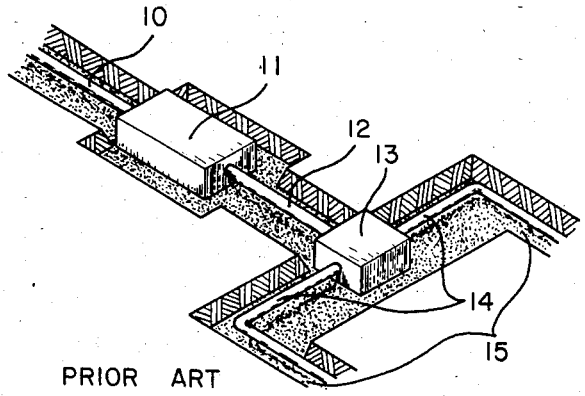
PRIOR ART Fig. 1
FIG. 1 is a cutaway perspective view of a typical prior art septic tank distribution box and absorption field.

With further reference to the drawings, a typical prior art septic tank sewage disposal system is shown in FIG. 1 including an inlet line 10 from the house or other structure, a septic tank 11, a connector line 12 between said septic tank 11 and distribution box 13. Finally, distribution lines 14 lead from the distribution box to the absorption field 15.

In the above described prior art system, the distribution box 13 has an open interior and, therefore, must be disposed absolutely level on a solid foundation that will not settle. If this is not accomplished, complete failure of the system will rapidly develop due to all of the septic tank effluent passing into one of the distribution lines, to the exclusion of the other, as a result of the natural phenomenon of liquids seeking their lowest level. Even when using the distribution system disclosed in U.S. Pat. No. 3,497,067 with a central partition and generally curved knife edge, problems can develop due to buildup of slow moving solid particles in the effluent.

The present invention, indicated generally at 16, can be used in conjunction with the usual inlet line 10 from the house or other structure, the standard septic tank 11, and the associated connector line 12. A coupling sleeve 17 is used to communicatively connect line 12 to the present invention. Coupling sleeves of the type shown are well known to those skilled in the art and further detailed discussion of the same is not deemed necessary.

Figure 2:
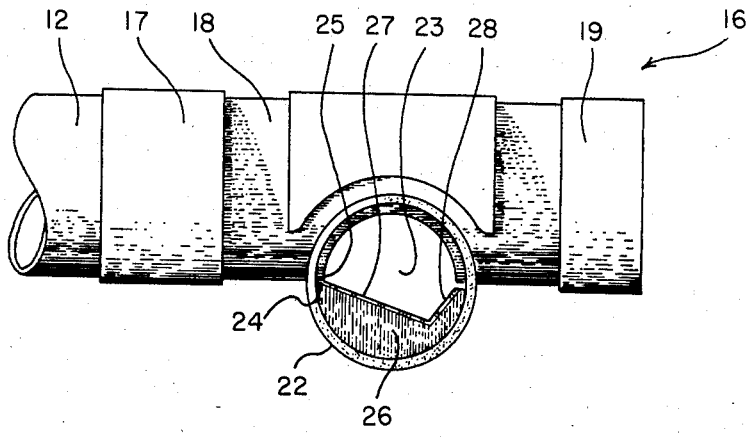
FIG. 2 is a side elevational view of the improved distribution means of the present invention.
Figure 3:
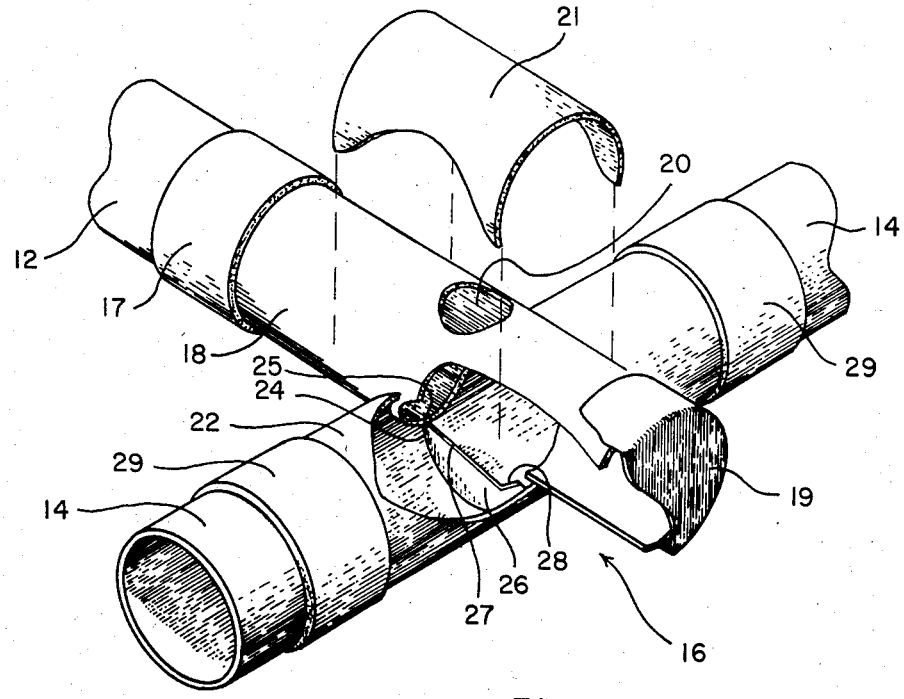
FIG. 3 is a partially cutaway perspective view thereof.

The inlet portion 18 of the present invention is effectively a continuation of the connector line 12 through coupling sleeve 17. An end cap 19 is used to seal the open end inlet portion 18. A clean-out opening 20 is provided in the upper portion of inlet 18 and a clean-out cover 21, formed from a plastic or similar material having a memory, is adapted to be snapped thereover as shown in FIGS. 2 and 3.

The distribution portion 22 of the present invention is notched into the inlet portion 18 with such portions being fused, welded, glued, cemented or otherwise secured to each other. A transverse opening 23 is provided in the lower portion of inlet 18 and, when viewed from the side as shown in FIG. 2, is slightly smaller in diameter than the interior diameter of the distribution portion 22. This forms a lip or overhang 24 at the throat 25 of the present invention which is defined as the juncture between the flow divider partition 26 and inlet portion 18.

The flow divider partition 26 is formed from a relatively thin material and includes a primary knife edge 27 which is rather steeply sloped downwardly from throat 25. A secondary knife edge 28 is formed in partition 26 at a slightly obtuse angle to the primary knife edge 27 as can clearly be seen in FIG. 2.

Although the improved distribution means of the present invention can be constructed from various types of metals, concrete, or the like, standard PVC type materials presently used in the plumbing industry have been found to be easy to work with and to stand up well under all types of weather and use conditions.

When it is desired to use the improved distribution means 16 of the present invention, the inlet portion 18 thereof is alignigly abutted against line 12 coming from septic tank 11 and sleeve 17 is slipped over the joint. A sealer such as PVC cement can then be used to permanently join line 12 with inlet portion 18. The distribution portion 20 of the present invention should always be disposed horizontally or as close to horizontally as possible. This is not always absolutely possible, however, and certainly the shifting of the soil thereunder can throw the same out of horizontal alignment as is encountered with the prior art distribution systems.

Once the distribution portion has been horizontally aligned, connector sleeves 29 can be slipped over the ends thereof and used to secure the same to distribution lines 14 leading into the absorption field 15. The clean-out cover 21 is then snapped over clean-out opening 20. All of the lines, tanks, distribution means, etc. can then be covered with dirt and the system is ready for use.

Whenever toilets are flushed, showers are taken, or the liquids are introduced into the full septic tank 11, treated effluent will be forced therefrom in equal amounts and at equal flow rates. At the beginning and end of each flow, there is slow movement which tends to allow any small particles in the effluent to settle. In normal flow lines, the next heavy flow will wash such particles on but they can and do build up on in any obstructions encountered. As the slow-moving effluent flow and the particles being carried thereby reach the throat area 25 of the present invention, such flow and its particles fall from lip 24 thus increasing the speed, whether it be a stream flow or a drip flow.

Further, any particles which happen to be lined up with the primary knife edge 27 of the flow divider partition 26, when they come into contact with such knife edge, will tend to be carried downwardly by the downwardly disposed angle of the same thus throwing such particles to one side of the partition or the other. Also, the next time a relatively heavy flow is introduced into the improved distribution means of the present invention from connector line 12, any particles lodged on the knife edge will be washed therefrom.

Should larger effluent solids or an accumulation of solids build up on the primary knife edge 27, they will be washed by the force of the heavier flows of effluent down such primary knife edge to its juncture with the secondary knife edge 28. This knife edge is set only a few degrees off perpendicular to the heavier effluent flows which will press the accumulated particles or solids against such secondary knife edge thereby effectively cutting the same into and with the help of the heavier effluent flow, wash the same to one side or the other of partition 26. Thus it can be seen that the flow divider partition 26 and its associated knife edges 27 and 28 are effectively self-cleaning.

From the above it can be seen that the present invention has the advantage of providing an improved distribution means which is relatively inexpensive to manufacture, is highly efficient in dividing effluent flows into distribution lines, and is effectively self-cleaning.

The present invention can, of course, be carried out in other specific ways than those herein set forth without departing from the spirit and essential characteristics of the invention. The present embodiments are, therefore, to be considered in all respects as illustrative and not restrictive and all changes coming within the meaning and equivalency range of the appended claims are intended to be embraced therein.

What is claimed is:

1. An improved flow divider comprising: a septic tank means; an effluent line communicatively connected at one end to said septic tank means; an inlet portion communicatively connected to the end of said effluent line opposite said septic tank means; a distribution portion communicatively connected to a transverse opening in the lower portion of said inlet portion to define (an overhanging) lip from which effluent must drop when passing from said inlet portion to said distribution portion, said transverse opening having a diameter slightly smaller than the interior diameter of said distribution portion; and partition like flow divider means disposed generally beneath said lip and extending across said distribution portion, said divider means including a steeply sloping first edge extending downwardly from a point adjacent said lip and a second edge extending upwardly from the end of said first edge opposite said lip at an angle greater than ninety degrees, with said first and second edges being of the knife edge type, whereby the buildup of particulate and other solids on or adjacent the flow divider can be prevented.

2. The improved flow divider of claim 1 wherein said partition like flow divider is constructed from relatively thin material.

3. The improved flow divider of claim 1 wherein a clean-out opening is provided in said inlet portion.

4. The improved flow divider of claim 3 wherein a cover is provided for said clean-out opening.

5. The improved flow divider of claim 4 wherein said cover is constructed from a material having a memory to allow the same to snap in place.

6. The improved flow divider of claim 5 wherein said cover is constructed from a plastic type material having a memory.

* * * * *